US011679916B2

(12) United States Patent
Le et al.

(10) Patent No.: US 11,679,916 B2
(45) Date of Patent: Jun. 20, 2023

(54) TWO-PART DISPENSING CLOSURE SYSTEM WITH INTERNAL SEAL AND METHODS OF USING THE SAME

(71) Applicant: Silgan Dispensing Systems Corporation, Richmond, VA (US)

(72) Inventors: Thanhhung Le, Henrico, VA (US); Brandon Ramsuer, Henrico, VA (US); John Scott, Olathe, KS (US); Frederick Thompson, Henrico, VA (US)

(73) Assignee: Silgan Dispensing Systems Corporation, Richmond, VA (US)

( * ) Notice: Subject to any disclaimer, the term of this patent is extended or adjusted under 35 U.S.C. 154(b) by 0 days.

(21) Appl. No.: 17/840,273

(22) Filed: Jun. 14, 2022

(65) Prior Publication Data

US 2022/0306359 A1 Sep. 29, 2022

Related U.S. Application Data

(63) Continuation of application No. 17/332,282, filed on May 27, 2021, now Pat. No. 11,377,273, which is a (Continued)

(51) Int. Cl.
*B65D 51/00* (2006.01)
*B65D 51/16* (2006.01)
(Continued)

(52) U.S. Cl.
CPC ..... *B65D 51/002* (2013.01); *B05B 11/1047* (2023.01); *B65D 47/20* (2013.01);
(Continued)

(58) Field of Classification Search
CPC .. B65D 51/002; B65D 47/20; B65D 51/1622; B65D 51/2835; B65D 2251/0006;
(Continued)

(56) References Cited

U.S. PATENT DOCUMENTS 2,771,218 A 11/1956 Henderson
3,208,639 A 9/1965 Marwell et al.
(Continued)

FOREIGN PATENT DOCUMENTS

CN 101203259 A 6/2008
CN 102665806 A 9/2012
WO 2011019217 A2 2/2011

OTHER PUBLICATIONS

Supplemental European Research Report, EP1988430, dated Sep. 20, 2022.

*Primary Examiner* — Donnell A Long
(74) *Attorney, Agent, or Firm* — Hinckley, Allen & Snyder, LLP; Stephen Holmes

(57) ABSTRACT

A dispensing closure system includes an upper closure portion and a lower closure portion including an axial flow conduit and a vent conduit. The upper closure portion is axially movable relative to lower closure portion between shipping and dispensing positions. A seal is disposed on the lower closure portion over the flow and vent conduits. A peripheral spacing strip is removably secured to the upper closure portion and engages with either the lower closure or the outside of the container to prevent movement. A piercing probe includes piercing elements in alignment with the flow and vent conduits for piercing the seal. In the shipping position, the piercing elements are spaced from the seal. However, when the spacing strip is removed and the upper closure portion is axially moved to the dispensing position, the piercing elements pierce the seal to open the flow conduit and the vent conduit.

17 Claims, 15 Drawing Sheets

Related U.S. Application Data continuation of application No. 16/895,193, filed on Jun. 8, 2020, now Pat. No. 11,027,898, which is a continuation of application No. 16/191,736, filed on Nov. 15, 2018, now Pat. No. 10,676,259.

(51) Int. Cl.
*B65D 51/28* (2006.01)
*B65D 47/20* (2006.01)
*B05B 11/10* (2023.01)

(52) U.S. Cl.
CPC ..... *B65D 51/1622* (2013.01); *B65D 51/2835* (2013.01); *B65D 2251/0006* (2013.01); *B65D 2251/0068* (2013.01); *B65D 2401/25* (2020.05)

(58) Field of Classification Search
CPC ..... B65D 2251/0068; B65D 2401/25; B65D 51/225; B65D 2251/0025; B65D 2251/0093; B05B 11/1047; B05B 11/0008; B05B 11/0044; B05B 11/1011
See application file for complete search history.

(56) References Cited

U.S. PATENT DOCUMENTS 3,780,951 A * 12/1973 Powers ..... B05B 11/1011 239/347
4,011,288 A 3/1977 Assenheimer et al.
4,582,223 A 4/1986 Kobe
5,318,206 A * 6/1994 Maas ..... B05B 11/0029 222/340
5,328,062 A * 7/1994 Tubaki ..... B05B 9/0883 222/401
5,335,821 A 8/1994 Osgar
5,373,973 A 12/1994 Foster
5,400,923 A 3/1995 Golias et al.
5,875,936 A 3/1999 Turbett et al.
6,708,852 B2 * 3/2004 Blake ..... B05B 9/0883 222/383.2
7,427,005 B1 9/2008 Lohrman
7,661,546 B2 * 2/2010 Jiang ..... A61J 11/04 215/11.1
8,083,107 B2 * 12/2011 Laible ..... B65D 47/32 222/189.09
2006/0283896 A1 * 12/2006 Kasting ..... B65D 51/20 222/549
2007/0280042 A1 12/2007 Yamanaka
2010/0282624 A1 11/2010 Paganuzzi
2011/0266171 A1 * 11/2011 Rovelli ..... B65D 51/2835 220/288
2012/0104048 A1 5/2012 Tseng
2014/0048430 A1 2/2014 Giraud
2016/0059255 A1 3/2016 Brannon et al.
2016/0272379 A1 9/2016 Skillin et al.
2017/0107030 A1 4/2017 Presche
2017/0258683 A1 9/2017 Tsakas et al.
2017/0297787 A1 10/2017 Defert et al.
2017/0355496 A1 12/2017 Seelhofer
2018/0362229 A1 12/2018 Paganuzzi
2020/0339312 A1 10/2020 Krautkramer
2021/0001361 A1 1/2021 Burmann et al.
2021/0078779 A1 3/2021 Paganuzzi et al.

* cited by examiner

TWO-PART DISPENSING CLOSURE SYSTEM WITH INTERNAL SEAL AND METHODS OF USING THE SAME

CROSS-REFERENCE TO RELATED APPLICATIONS

This application is a continuation of U.S. application Ser. No. 17/332,282, filed May 27, 2021, which is a continuation of U.S. application Ser. No. 16/895,193, filed Jun. 8, 2020, now U.S. patent Ser. No. 11/027,898, issued Jun. 8, 2021 which is a continuation of U.S. application Ser. No. 16/191,736 filed Nov. 15, 2018, now U.S. patent Ser. No. 10/676,259, issued Jun. 9, 2020.

BACKGROUND OF THE DISCLOSURE

Embodiments of the invention relate to dispensing closures for liquid pumps and sprayers, and more particularly to a novel closure assembly that includes features for preventing leaks during individual e-commerce shipments.

As direct to consumer e-commerce sales continue to grow, liquid spray and pump products, which would normally be purchased off the shelf at brick and mortar stores, are now being shipped as individual sale units without secondary packaging or protection. Bulk shipping of these products from the manufacturer to distributors has generally not encountered significant leak problems since multiple containers or bottles are packaged in specially designed boxes to accommodate their unique shapes. E-commerce retailers remove individual units from the bulk packaging and attempt to ship the individual containers to the consumer in less expensive and less protective packaging. Individual shipments are more prone to rough handling, movement within the retailer packaging and thus more prone to closure breakage and container leakage. Many e-commerce retailers have resorted to placing such items into bags in order to contain leaks if and when they occur. However, the bags only prevent other items in the shipment from being ruined. They do not directly address the underlying problem of leak prevention. Accordingly, there is an existing need for dispensing closures which include features for preventing leaks during both bulk shipment and/or individual shipment, prior to receipt of the product by the end consumer.

Consumers continually drive the need for novel dispensing devices which provide easier use, more functionality, better ergonomics and better dispensing options for a variety of liquid or fluid products for various uses. Accordingly, there is always a need for improved dispensing options.

SUMMARY OF THE INVENTION

According to certain exemplary embodiments of the invention, the present disclosure generally provides a two-part dispensing closure comprising a dispensing head, an upper closure portion, a lower closure portion, an internal seal to prevent leaks during e-commerce shipment of individual units and a piercing probe. The closure is mounted on the neck of a container which contains a liquid product for dispensing.

The dispensing head is generally a spray-type dispenser with a depending throat portion which is snap received with the upper closure portion. The throat portion has an axially centered flow path to the piston chamber. The exemplary embodiments as illustrated each depict a spray-type dispensing head for liquids. However, it should be understood that some embodiments of the invention may also include pump dispensers and/or other dispenser heads for dispensing shampoos, soaps, lotions, gels and other viscous flowable products. Any container holding a liquid or flowable product would benefit from the present technology.

The lower closure portion has an outer skirt which is threadedly received with the neck of the container and it further includes an axial flow conduit and a vent conduit adjacent to the flow conduit. A dip tube extends from a dip tube port on the bottom of the flow conduit. An annular neck extending from the upper closure portion is threadedly mated with a corresponding annular recess in the lower closure portion and is axially movable relative to lower closure portion upon rotation thereof. In this regard, the upper closure is movable between an extended shipping position and a contracted dispensing position which will be described further herein.

In some embodiments the upper and lower closure portions may simply be slidably movable relative to each other and snap locked in the extended and contracted positions.

To create a seal during shipping, a foil seal is disposed on an upper surface of the lower closure portion over both the flow conduit and the vent conduit. The vent conduit is preferably located within a concentric annular recess immediately adjacent to the axial flow conduit and the seal extends over the central flow conduit and the annular recess.

To prevent movement of the upper closure relative to the lower closure during shipment and handling, a peripheral spacing strip is removably secured to a lower lip of an outer skirt on the upper closure portion. The strip is attached by a weakened tear line and includes a pull tab for grasping and pulling the strip for removal. In the described embodiment, the spacing strip engages the top deck of the lower closure and prevents relative movement thereof.

The tubular piercing probe has an upper portion received in the flow path of the throat of the dispensing head and a lower portion extending axially through the upper closure portion wherein the lower portion includes piercing elements in alignment with the flow conduit and the vent conduit for piercing thereof.

In use, the piercing elements are spaced from the seal when the upper closure portion is in the inactive extended shipping position. However, when the spacing strip is removed and the upper closure portion is rotated and axially moved from the inactive shipping position to the active dispensing position the piercing elements move downwardly and are effective for piercing the seal to open the flow conduit and the vent conduit and allow liquid from the container to travel through the piercing probe into the dispensing head.

In some embodiments, the skirt of the lower closure portion may be secured to the container neck by a bayonet connection.

In some embodiments, the spray dispensing head may have an offset flow conduit and require a two-part piercing probe.

In some embodiments, the lower closure portion is seated within the neck of the container and the outer skirt of the upper closure portion is threaded for mounting directly onto the container neck. In this regard, the outer skirt is somewhat elongated and the tear away spacing strip engages a shoulder portion of the container to prevent rotation and movement of the upper closure portion.

In another exemplary embodiment the closure system comprises a spray dispensing head, a closure ring receiving the dispensing head, a cup-shaped bottle adapter having an axial flow conduit and a vent conduit adjacent to the flow conduit, a reversible tubular flow adapter, and a removable seal.

The bottle adapter is received within the neck of the container and a dip tube extends from a dip tube port on the bottom wall of the adapter. The vent conduit is in the bottom wall as well, adjacent to the flow conduit.

The reversible tubular flow adapter has a stem portion at a first end and an annular seat portion at a second end. The flow adapter provides two different functions depending on its deployed configuration. In a shipping configuration, the stem portion is received into the axial flow conduit of the bottle adapter with the seat portion sitting within the interior of the bottle adapter. The removable seal is sealed around the peripheral upper lip of the bottle adapter to create a seal and prevent leaks through either the flow conduit or the vent conduit. The closure ring captures the bottle adapter within the container neck until it reaches the end consumer. Once received, the user removes (unscrews) the closure ring, removes (peels away) the seal, removes the flow adapter and reverses the flow adapter configuration to mount the seat adapter end onto the flow conduit. The closure ring and dispenser head are reattached with the stem portion of the flow adapter now extending up into the flow conduit of the dispenser head.

Other embodiments may also include alternate types of dispensing heads depending on the product type.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 2:
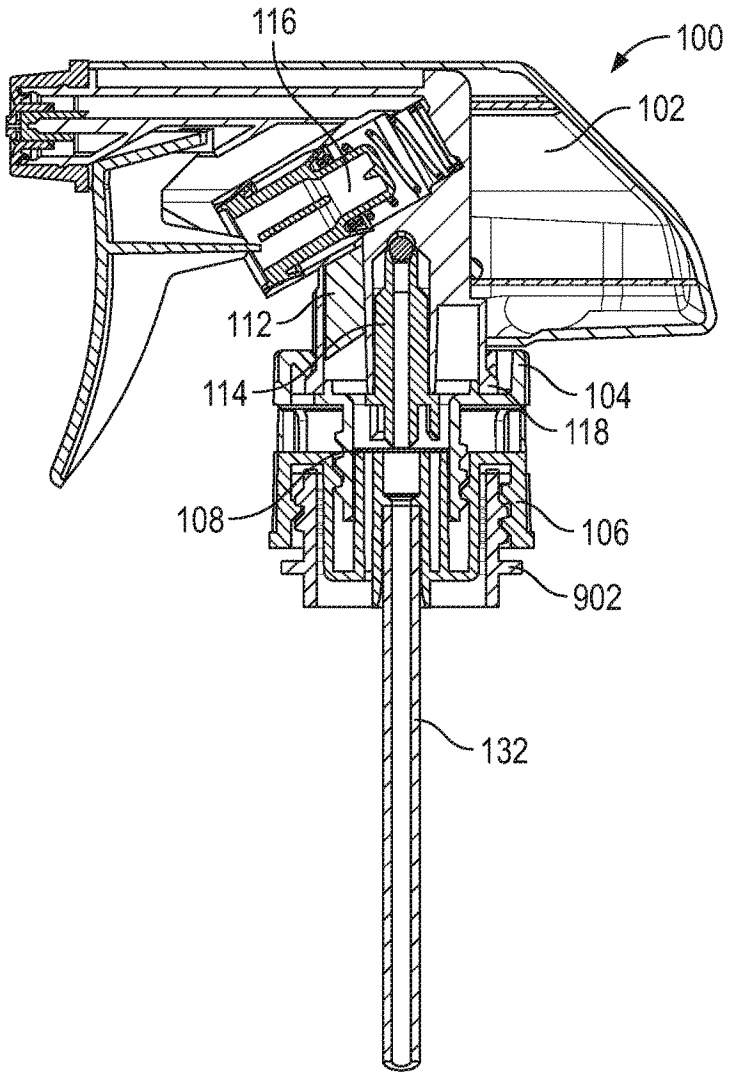
FIG. 2 is a cross-sectional view thereof taken along line 2-2 of FIG. 1.
Figure 1:
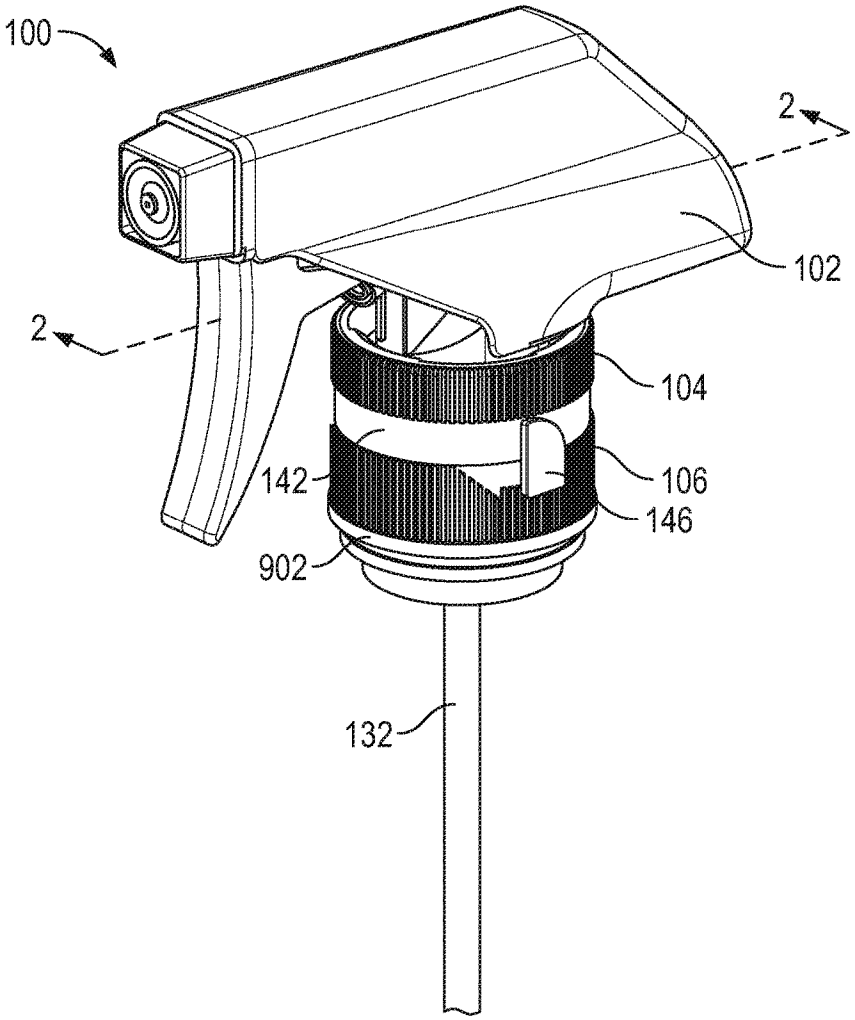
FIG. 1 illustrates a two-part dispensing closure system in accordance with an exemplary embodiment of the invention.

Certain exemplary embodiments will now be described to provide an overall understanding of the principles of the structure, function, manufacture, and use of the device and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present disclosure. Further, in the present disclosure, like-numbered components of the embodiments generally have similar features, and thus within a particular embodiment each feature of each like-numbered component is not necessarily fully elaborated upon. Additionally, to the extent that linear or circular dimensions are used in the description of the disclosed systems, devices, and methods, such dimensions are not intended to limit the types of shapes that can be used in conjunction with such systems, devices, and methods. A person skilled in the art will recognize that an equivalent to such linear and circular dimensions can easily be determined for any geometric shape. Further, to the extent that directional terms like top, bottom, up, or down are used, they are not intended to limit the systems, devices, and methods disclosed herein. A person skilled in the art will recognize that these terms are merely relative to the system and device being discussed and are not universal.

According to certain exemplary embodiments of the invention as described herein, the present disclosure generally provides a two-part dispensing closure system including features for preventing leaks during the shipment and handling of individual e-commerce sales.

Referring to FIGS. 1-11, and according to some embodiments of the invention, a dispensing closure system 100 may comprise a dispensing head 102, an upper closure portion 104, a lower closure portion 106, an internal seal 108 to prevent leaks during e-commerce shipment of individual units and a piercing probe 110. The closure system 100 may be mounted on the neck 902 of a container 900 which contains a liquid product for dispensing.

The exemplary dispensing head 102 is illustrated as a spray-type trigger dispenser head with a depending throat portion 112 that is snap received with the upper closure portion 104. The throat portion 112 has an axially centered flow path 114 to the trigger piston chamber 116. Referring to FIG. 2, the lower edge of the throat portion includes an outwardly turned flange 118 which is snap received beneath corresponding ridges 120 projecting inwardly from an outer skirt 122 of the upper closure portion 104. This mounting arrangement allows the dispensing head 102 to rotate relative to the upper closure portion 104 for filling line handling and torqueing of the closure 100 onto the bottle 900 while maintaining dispensing head orientation relative to the bottle or container 900.

The lower closure portion 106 has an outer skirt 124 which is threadedly received with the neck 902 of the container 900 and it further includes an axial flow conduit 126 and a vent conduit 128 adjacent to the flow conduit 126. A gasket 130 may be received between the lower closure portion 106 and the neck 902 of the container 900 to form a better seal with the container 900. A dip tube 132 extends from a dip tube port 134 on the bottom of the flow conduit 126. An annular neck 136 extending from the upper closure portion 104 is threadedly mated with a corresponding annular recess 138 in the lower closure portion 106 and is axially movable relative to lower closure portion 106 upon rotation thereof. In this regard, the upper closure portion 104 is movable between an extended shipping position (See FIGS. 8 and 9) and a contracted dispensing position (See FIGS. 10 and 11) which will be described further herein.

In some embodiments the upper and lower closure portions 104,106 may simply be slidably movable relative to each other (telescoping) and snap locked in the extended and contracted positions.

Figure 3:
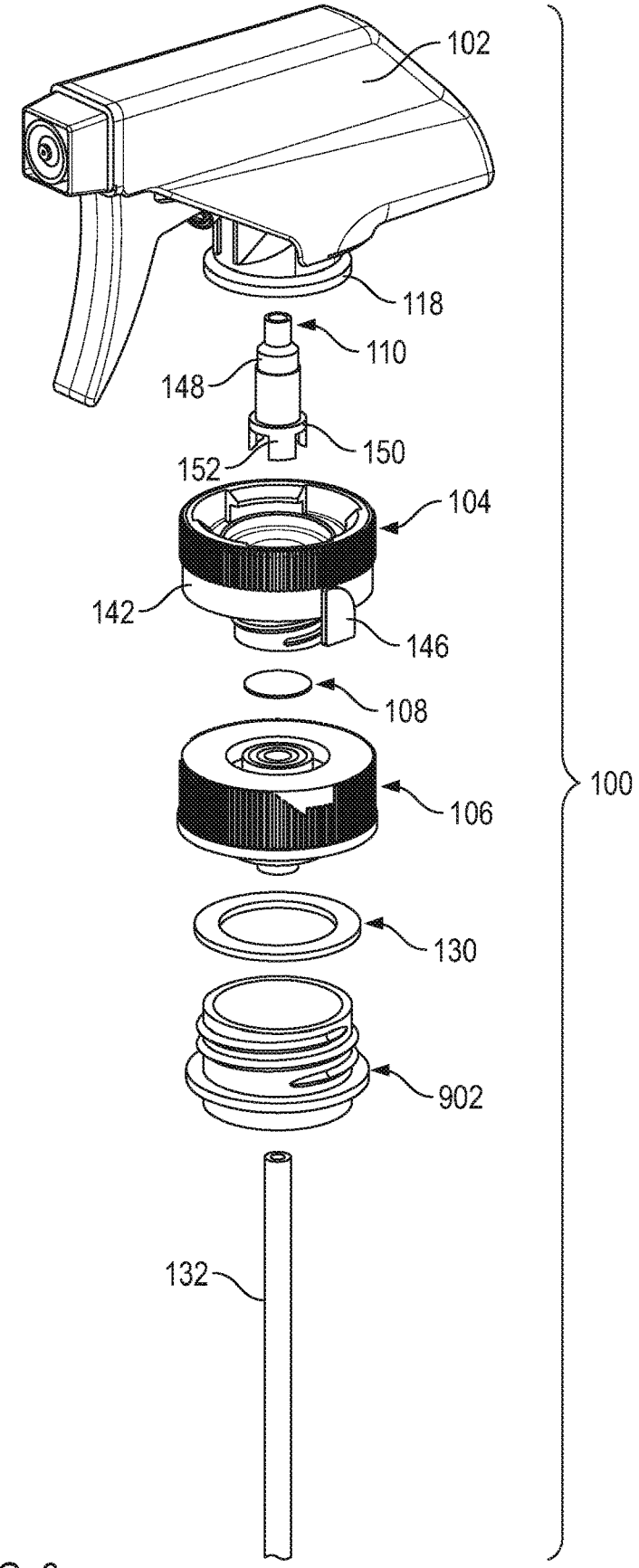
FIG. 3 is an exploded perspective view thereof.
Figure 4:
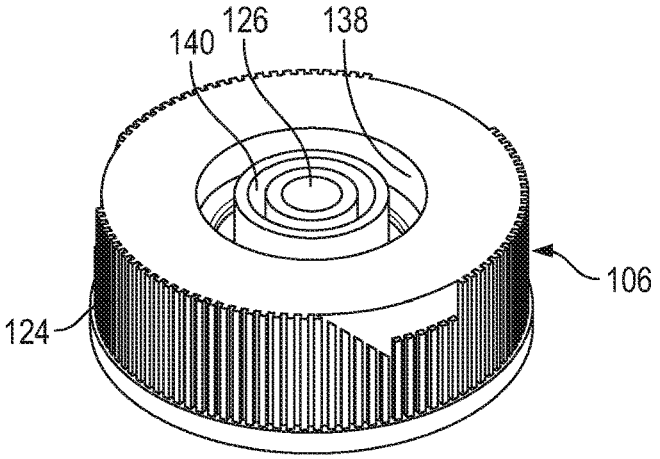
FIGS. 4-5 are perspective views of the upper closure portion.
Figure 5:
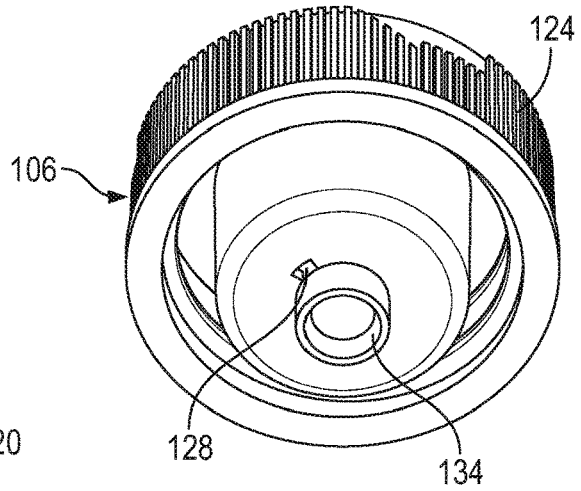
Figure 6:
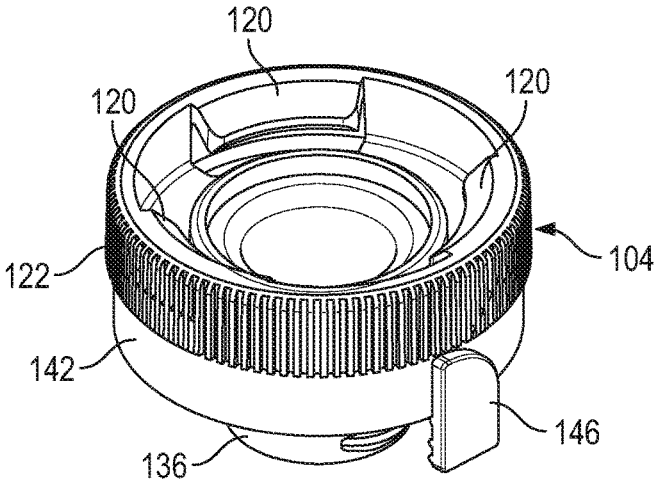
FIGS. 6-7 are perspective views of the lower closure portion.
Figure 7:
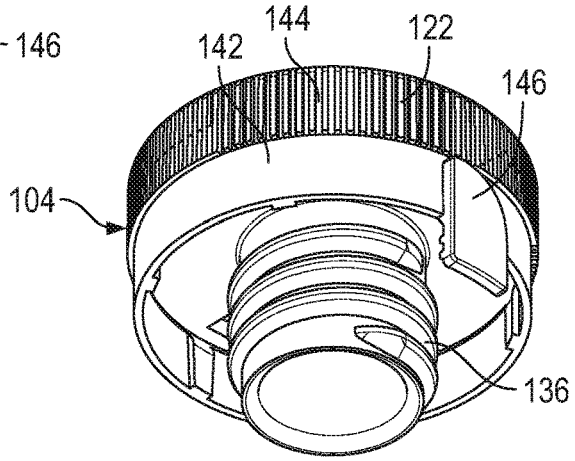
Figure 9:
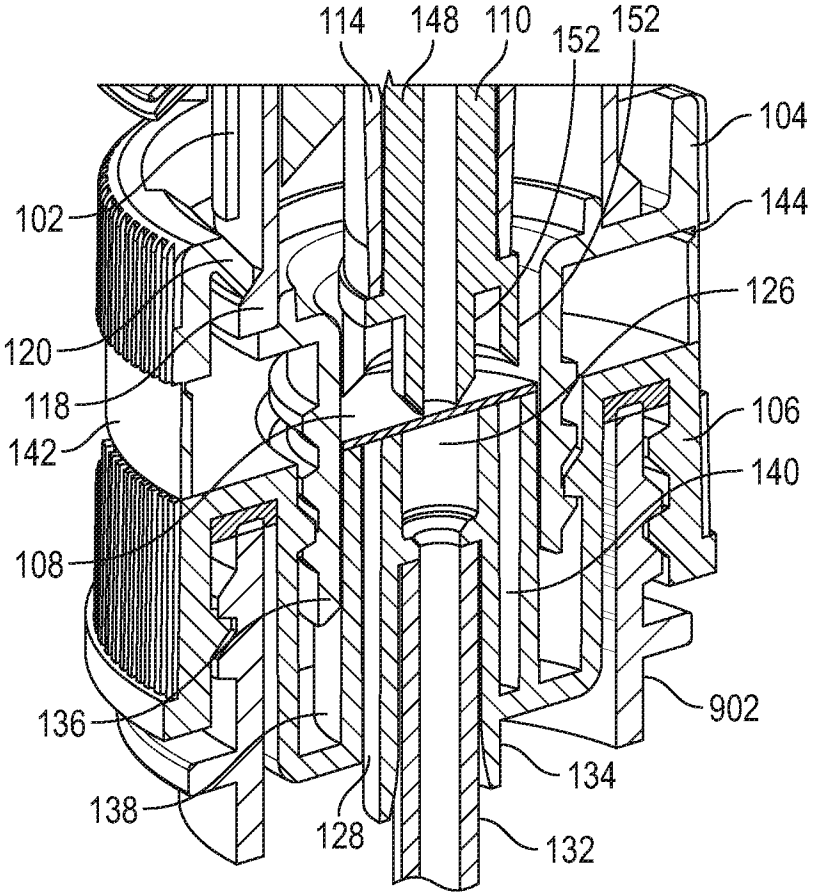
FIG. 9 is a cross-sectional view thereof taken along line 9-9 of FIG. 8.

As best seen in FIGS. 3 and 9, to create a seal during shipping, the seal 108 is disposed on an upper surface of the lower closure portion 106 over both the flow conduit 126 and the vent conduit 128. The seal 108 may be a foil seal or other suitable type seal which is capable of being pierced and thereafter not obstructing the flow path once pierced. The vent conduit 128 is preferably located within a concentric annular recess 140 immediately adjacent to the axial flow conduit 126 and the seal 108 extends over both the central flow conduit 126 and the annular recess 140.

Referring to FIGS. 8-11, to prevent movement of the upper closure relative to the lower closure during shipment and handling, a peripheral spacing strip 142 is removably secured to a lower lip of the outer skirt 122 on the upper closure portion 104. The removable spacing strip 142 is attached by a weakened tear line 144 and includes a pull tab 146 for grasping and pulling or tearing the strip 142 for removal. In the described embodiment, the spacing strip 142 engages the top deck of the lower closure 106 (See FIG. 9) and prevents relative downward movement thereof.

The tubular piercing probe 110 has an upper portion 148 received in the flow path 114 of the dispensing head 102 and a lower portion 150 extending axially through the upper closure portion 104. The lower portion 150 includes piercing elements 152 in alignment with the flow conduit 126 and the vent conduit 128 for piercing thereof.

Figure 8:
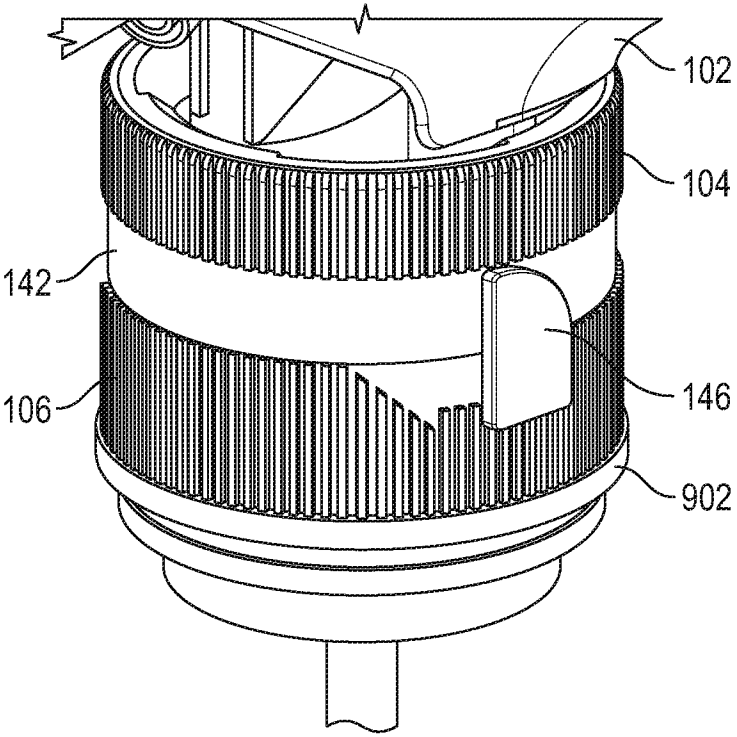
FIG. 8 is an enlarged perspective view of the closure assembly with the peel-away spacer intact.
Figure 11:
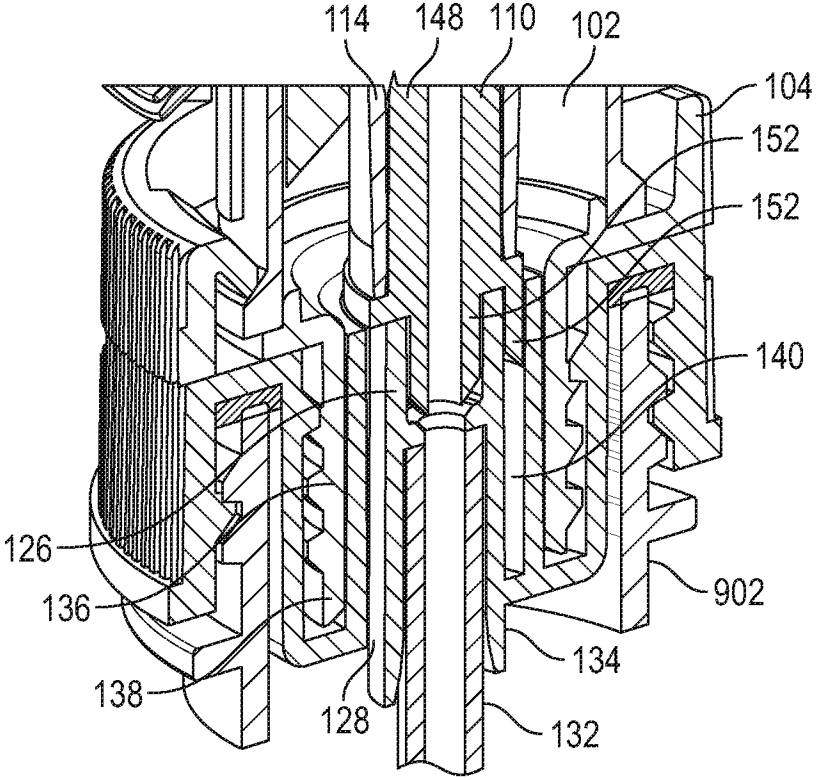
FIG. 11 is a cross-sectional view thereof taken along line 11-11 of FIG. 10.
Figure 10:
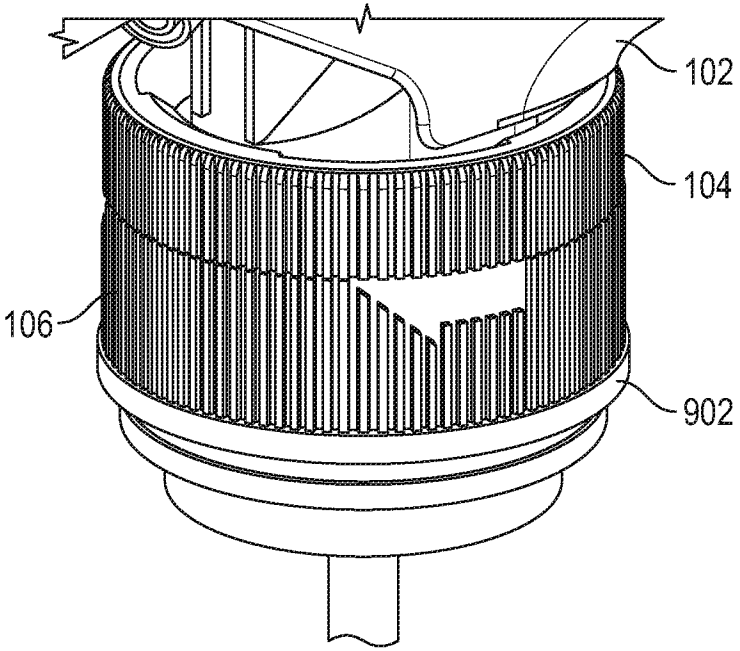
FIG. 10 is an enlarged perspective view of the closure assembly with the peel-away spacer removed.
Figure 13:
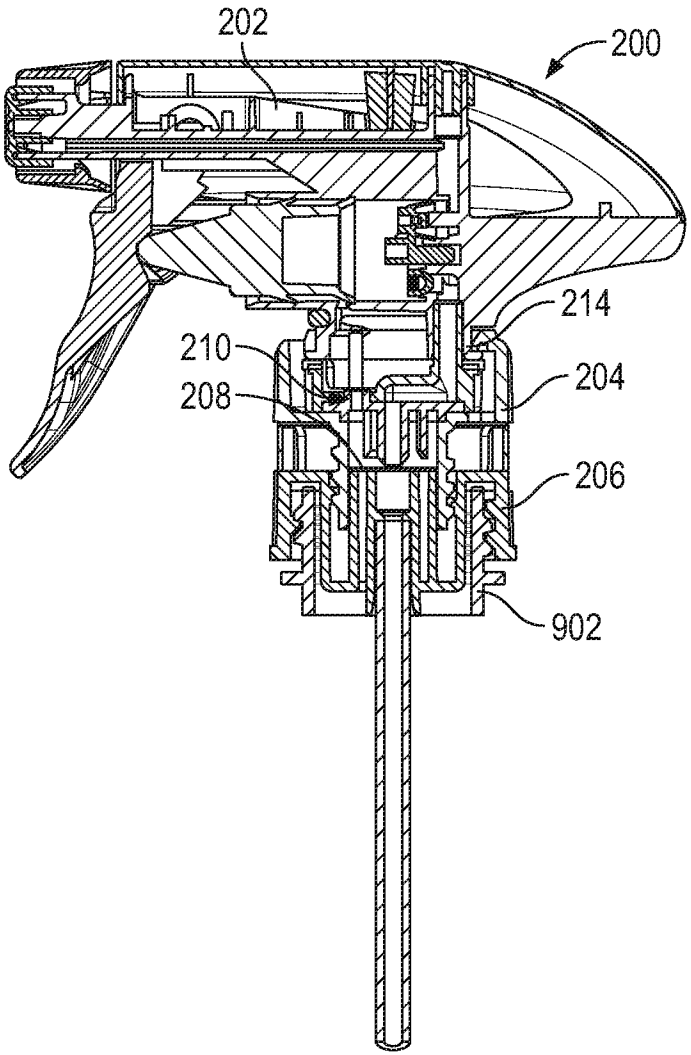
FIG. 13 is a cross-sectional view thereof taken along line 13-13 of FIG. 12.
Figure 12:
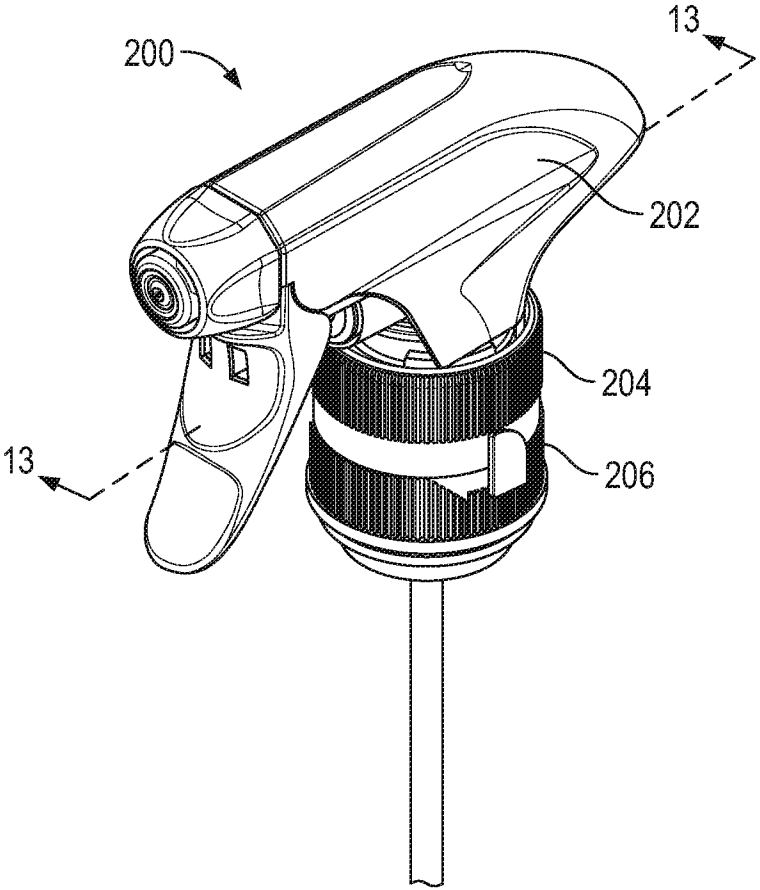
FIG. 12 is a perspective view of another exemplary embodiment including an alternative spray dispensing head.
Figure 15:
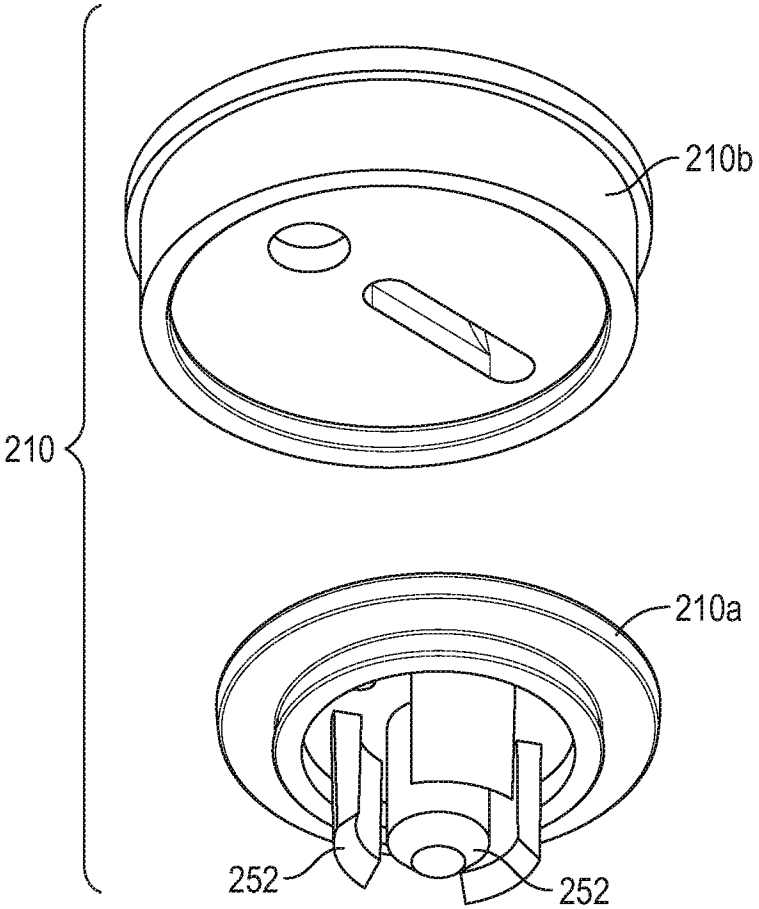
FIGS. 14-15 are exploded perspective views of the two-piece piercing probe thereof.
Figure 14:
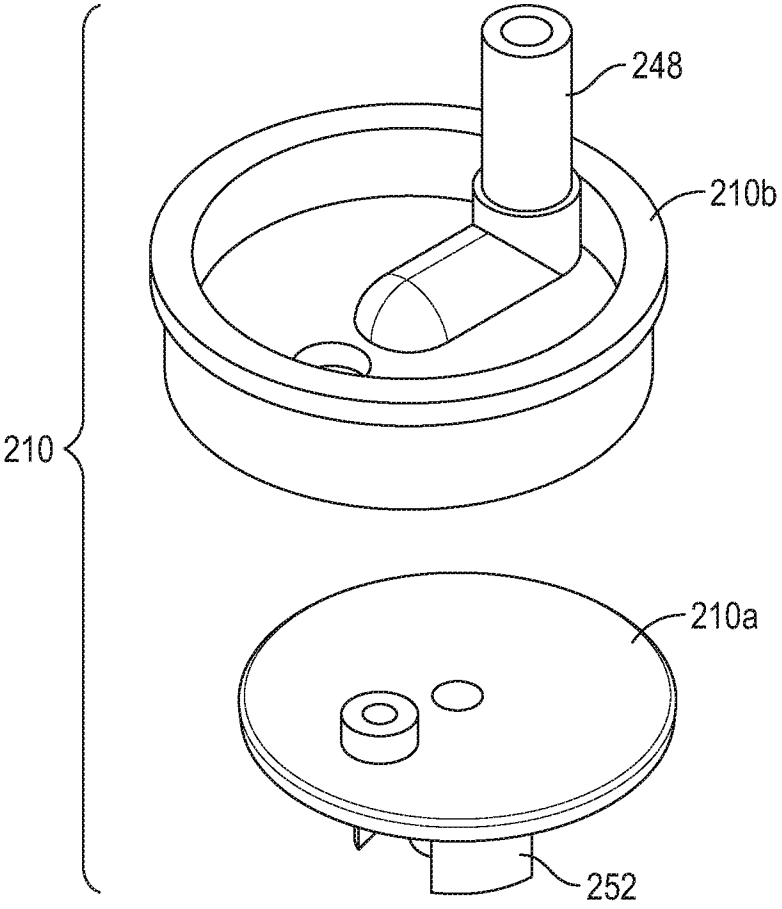
Figure 17:
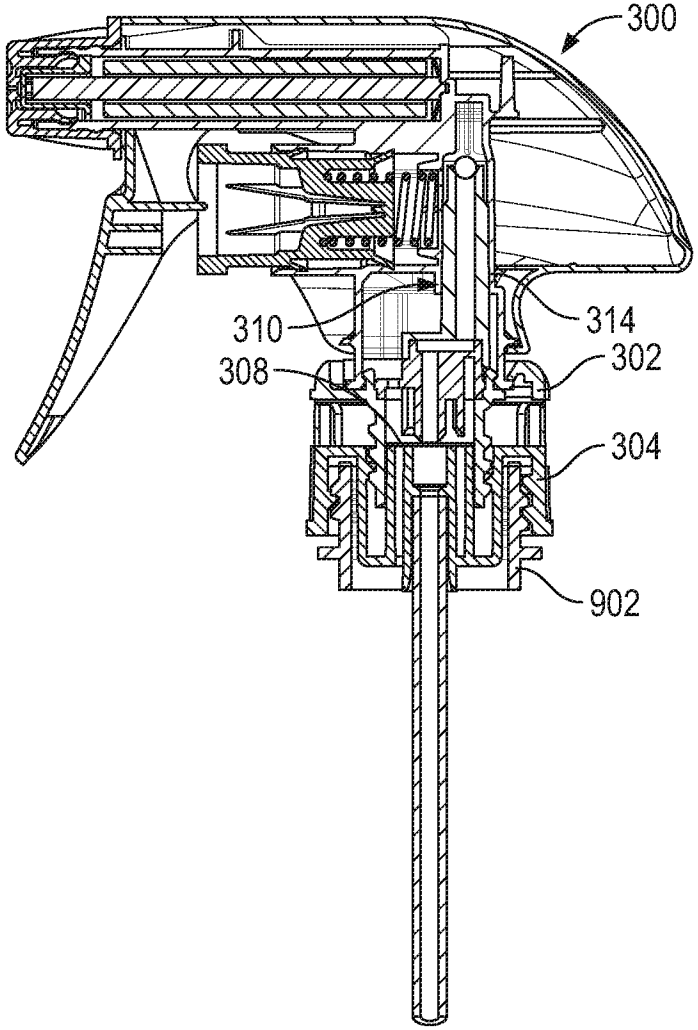
FIG. 17 is a cross-sectional view thereof taken along line 17-17 of FIG. 16.
Figure 16:
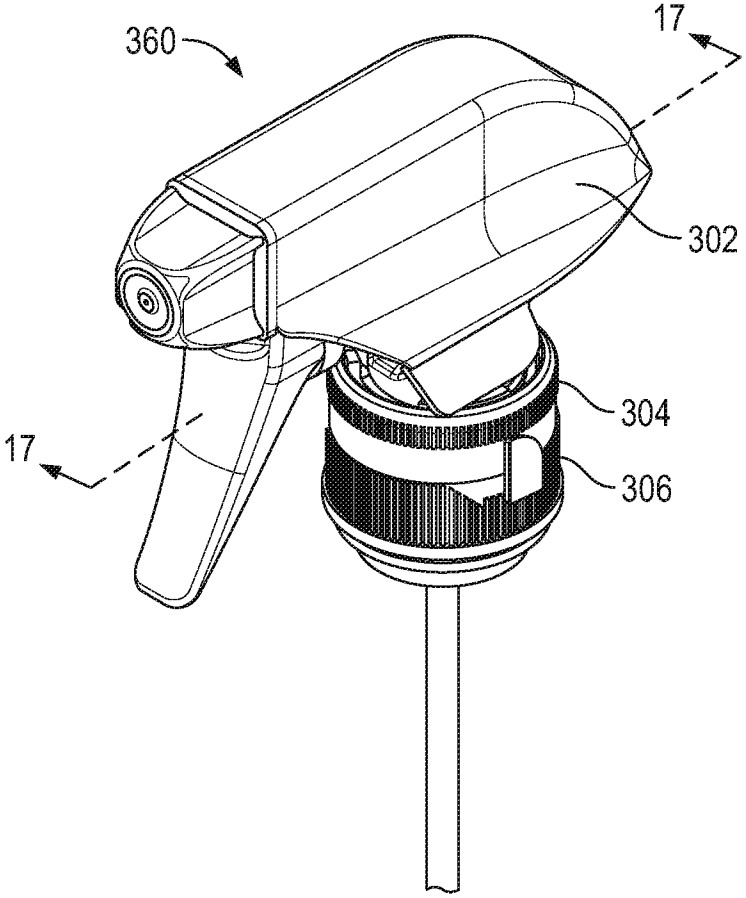
FIG. 16 is a perspective view of yet another exemplary embodiment including another alternative spray dispensing head.
Figure 19:
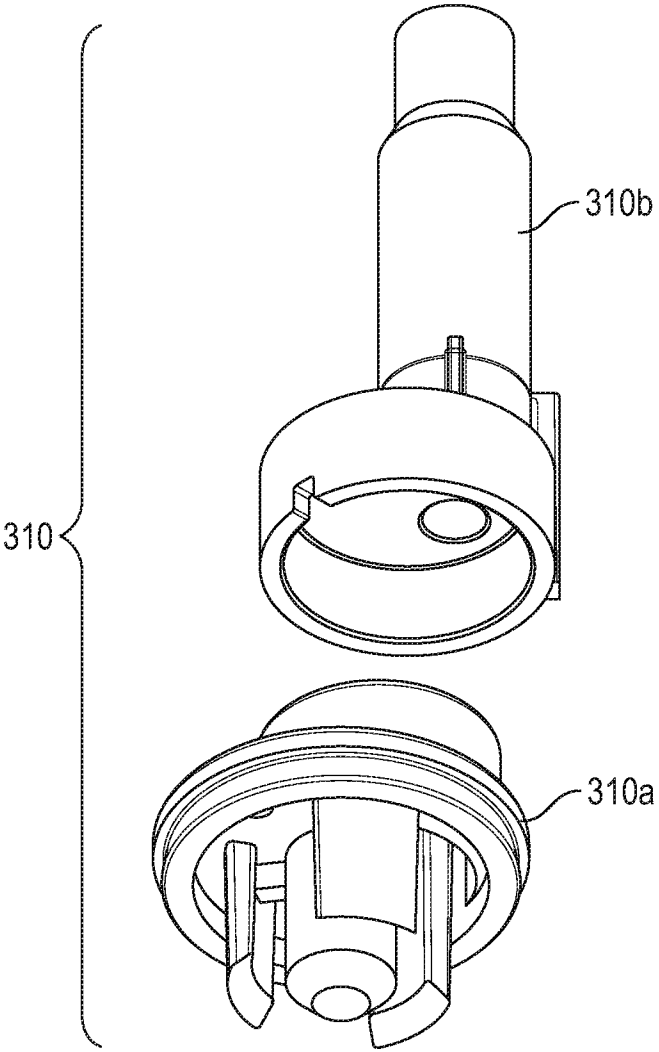
FIGS. 18-19 are exploded perspective views of the two-piece piercing probe thereof.
Figure 18:
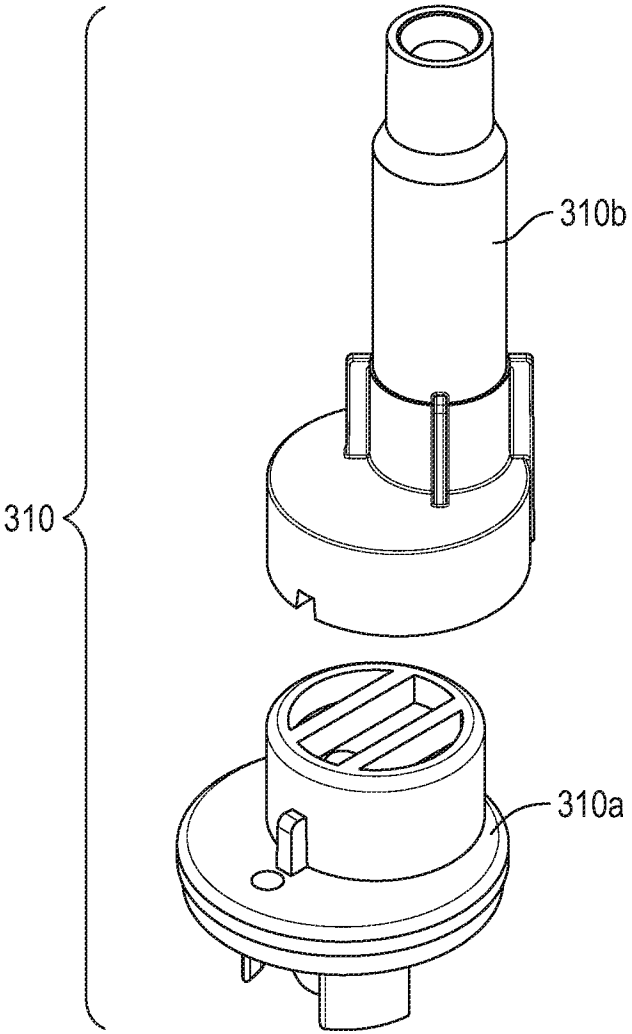

Still referring to FIGS. 8-11, in use, the piercing elements 152 are spaced from the seal 108 when the upper closure portion 104 is in the inactive extended shipping position (FIGS. 8-9). However, when the spacing strip 142 is removed and the upper closure portion 104 is rotated relative to the lower closure portion 106 and axially moved from the inactive shipping position to the active dispensing position (FIGS. 10-11) the piercing elements 152 move downwardly and pierce the foil seal 108 to open the flow conduit 126 and the vent conduit 128 and allow liquid from the container 900 to travel through the piercing probe 110 into the dispensing head 102 (See arrow in FIG. 11).

In some embodiments, the skirt 124 of the lower closure portion 106 may be secured to the container neck 902 by a bayonet connection.

In some embodiments, the spray dispensing head may have an offset flow conduit. Referring to FIGS. 12-15, another exemplary embodiment is generally indicated at 200 and includes a dispensing head 202, an upper closure portion 204, a lower closure portion 206, an internal seal 208 and a piercing probe 210.

The dispensing head 202 includes an offset flow conduit 214. It is a feature of the present embodiments that the piercing probe is located coaxial to the flow conduit in the lower dispensing closure so that upon rotation, the piercing elements are axially moved to pierce the seal in the required locations. In order to allow rotation of dispensing head 202 with an offset flow conduit 214 relative to the upper closure portion 204 and rotation of the upper closure portion 204 relative to the lower closure portion 206, the piercing probe 210 is separated into two discrete components 210A,210B (See FIGS. 14 and 15). The lower piercing component 210A provides the axially oriented piercing elements 252 while the upper component 210 provides the offset stem portion 248 extending upwardly for receipt into the flow conduit 214. Otherwise, the upper and lower closure portions 204, 206 are the same as described hereinabove.

Similarly, illustrated in FIGS. 16-19 is another exemplary embodiment generally indicated at 300 and including a dispensing head 302, an upper closure portion 304, a lower closure portion 306, an internal seal 308 and a piercing probe 310.

This embodiment has a slightly different spray head configuration 302, but also including an offset flow path 314 through the throat. The upper and lower piercing components 310A,310B are similar to those previously described (210A,201B).

Figure 20:
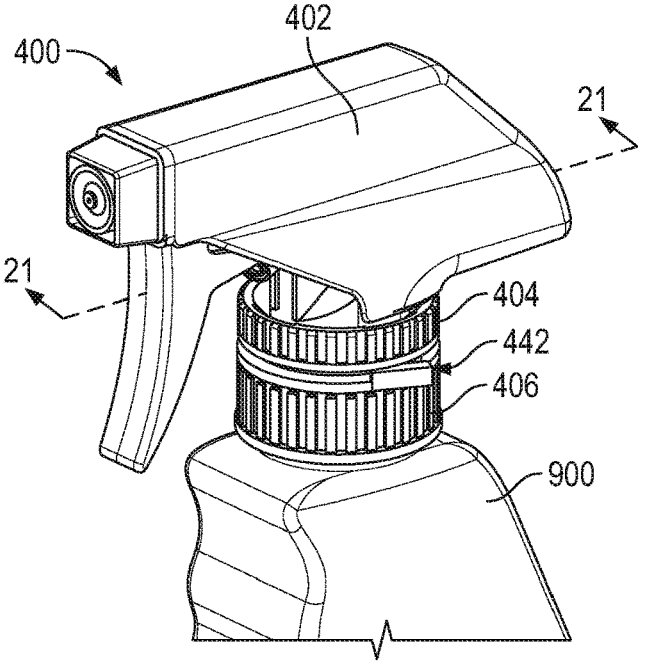
FIG. 20 is a perspective view of another exemplary embodiment including a narrower peel away spacing strip.
Figure 21:
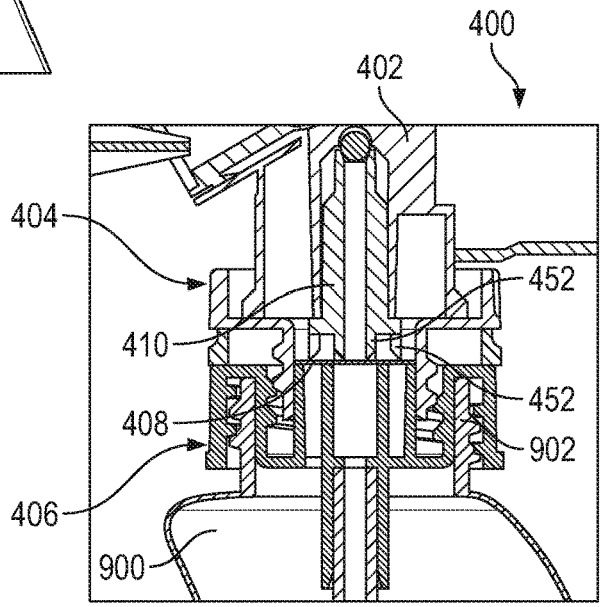
FIG. 21 is a cross-sectional view thereof taken along line 21-21 of FIG. 20.
Figure 22:
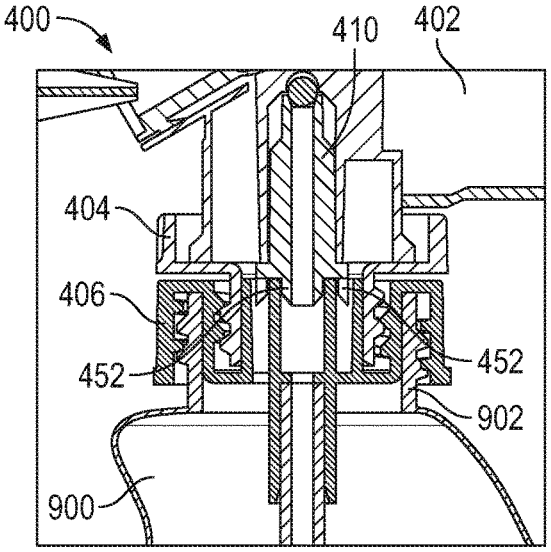
FIG. 22 is another cross-sectional view thereof with the spacing strip removed and the upper closure portion tightened down onto the lower closure portion.
Figure 23:
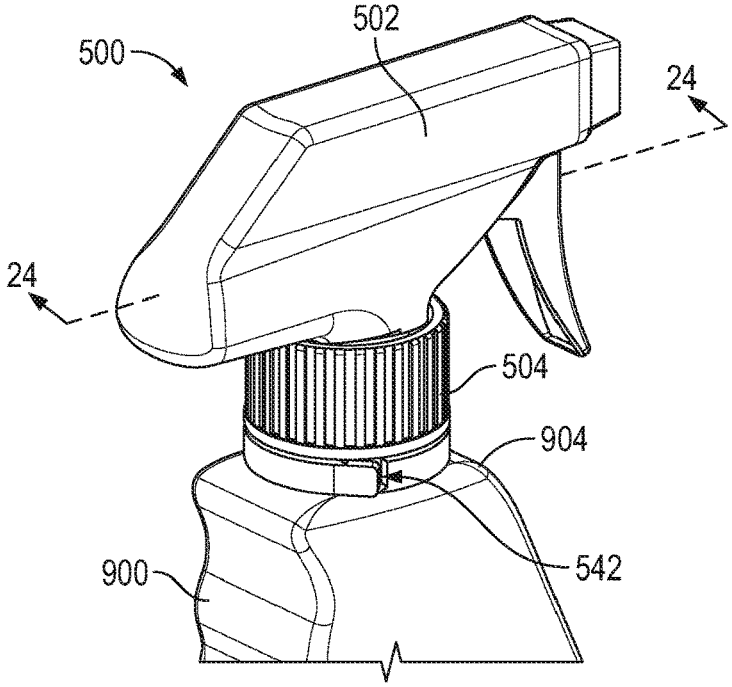
FIG. 23 is a perspective view of still another exemplary embodiment including a peel away strip and in internal bottle neck adapter.

Referring now to FIGS. 20-22, another exemplary embodiment is illustrated and generally indicated at 400. This embodiment 400 also includes a dispensing head 402, upper closure portion 404, lower closure portion 406, seal 408 and piercing probe 410 as previously described. The current embodiment 400 however, has a lower height profile and takes advantage of a narrower spacing strip 442 between the upper closure portion 404 and the lower closure portion 406. The lower profile also requires slightly shorter piercing elements 452 on the piercing probe 410, but it otherwise structurally and functionally the same as embodiment 100 described hereinabove.

In some embodiments, the lower closure portion is seated within the neck 902 of the container 900 and the outer skirt of the upper closure portion is threaded for mounting directly onto the container neck. Referring to FIGS. 23-26, an embodiment in this configuration is generally indicated at 500. The dispensing closure system 500 includes a dispensing head 502, a lower closure portion 506 received and seated within the neck 902 of the container 900, an upper closure portion 504 having an outer skirt 522 that is somewhat elongated or extended, a seal 508 and a coaxial piercing probe 510. In contrast with the previous embodiments, the tear away spacing strip 542 on the bottom of the skirt 522 engages a shoulder portion 904 of the container 900, rather than the lower closure portion, to prevent rotation and movement of the upper closure portion 504 as previously described.

Figure 26:
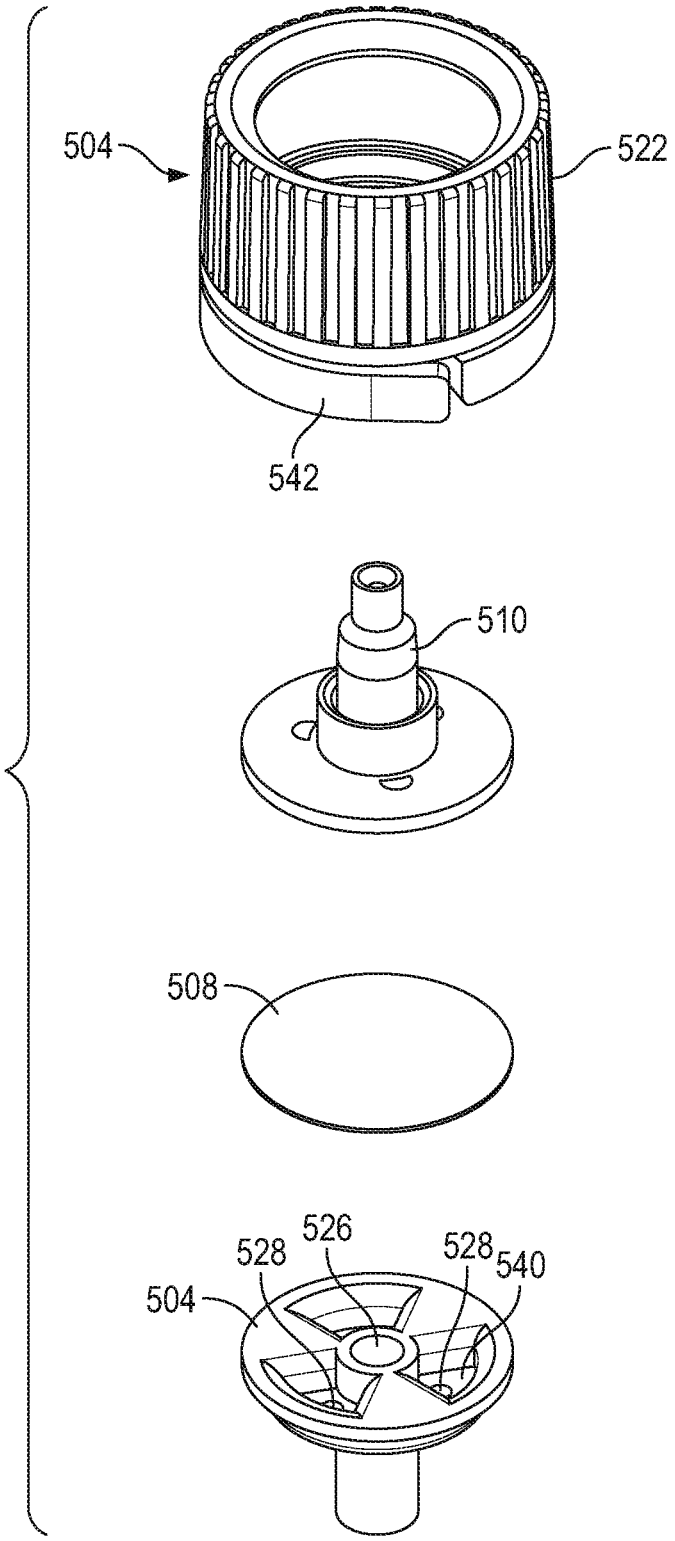
FIG. 26 is an exploded view of the adapter, closure and seal thereof.
Figure 27:
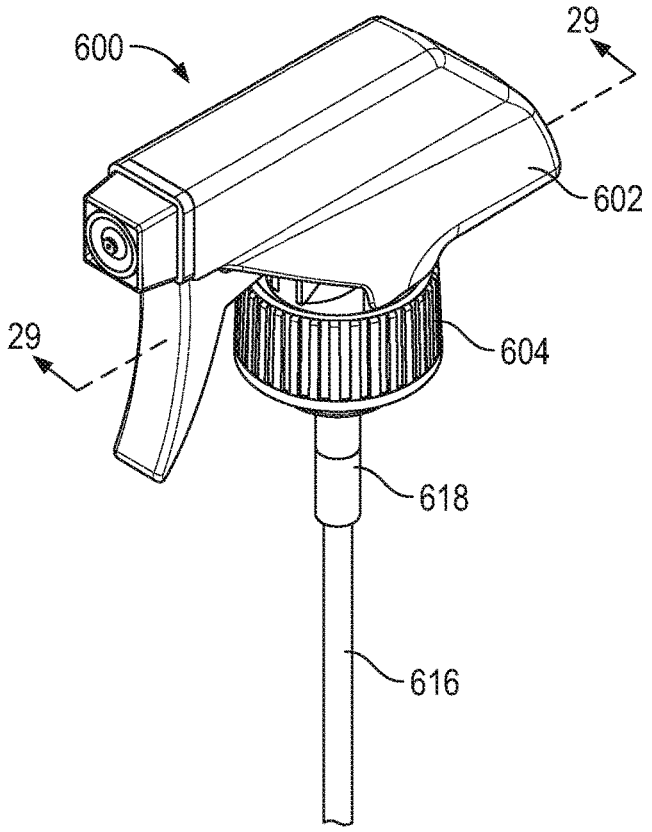
FIG. 27 is a perspective view of a further exemplary embodiment including an internal adapter cup and a reversible piercing probe.
Figure 28:
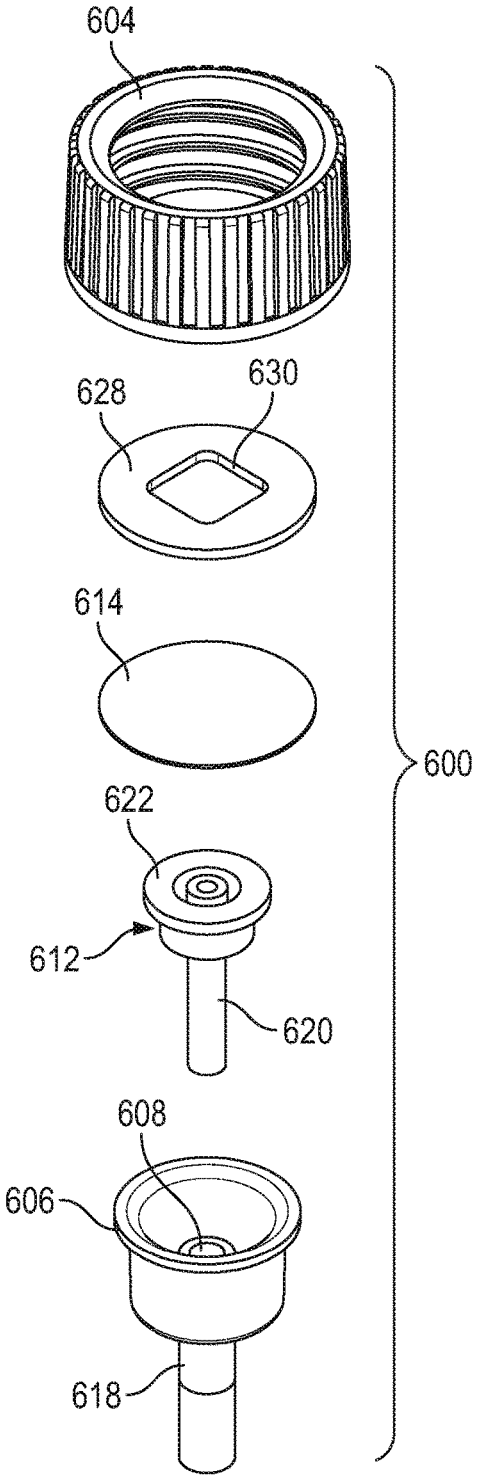
FIG. 28 is an exploded view thereof.
Figure 30:
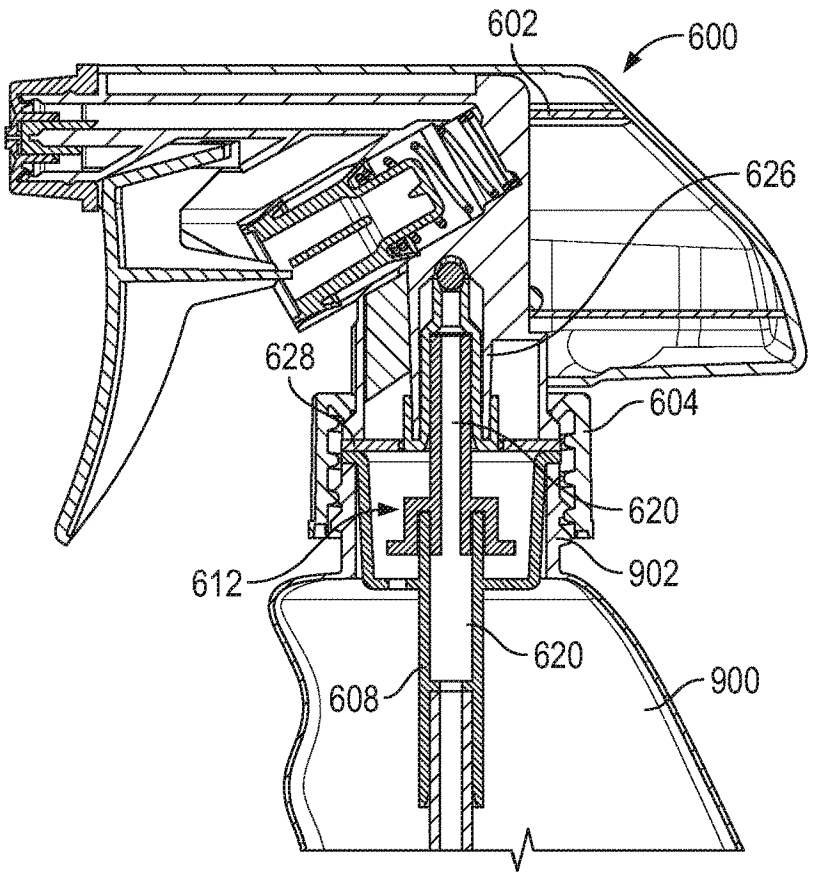
FIG. 30 is another cross-sectional view illustrating the piercing probe in the use position.
Figure 29:
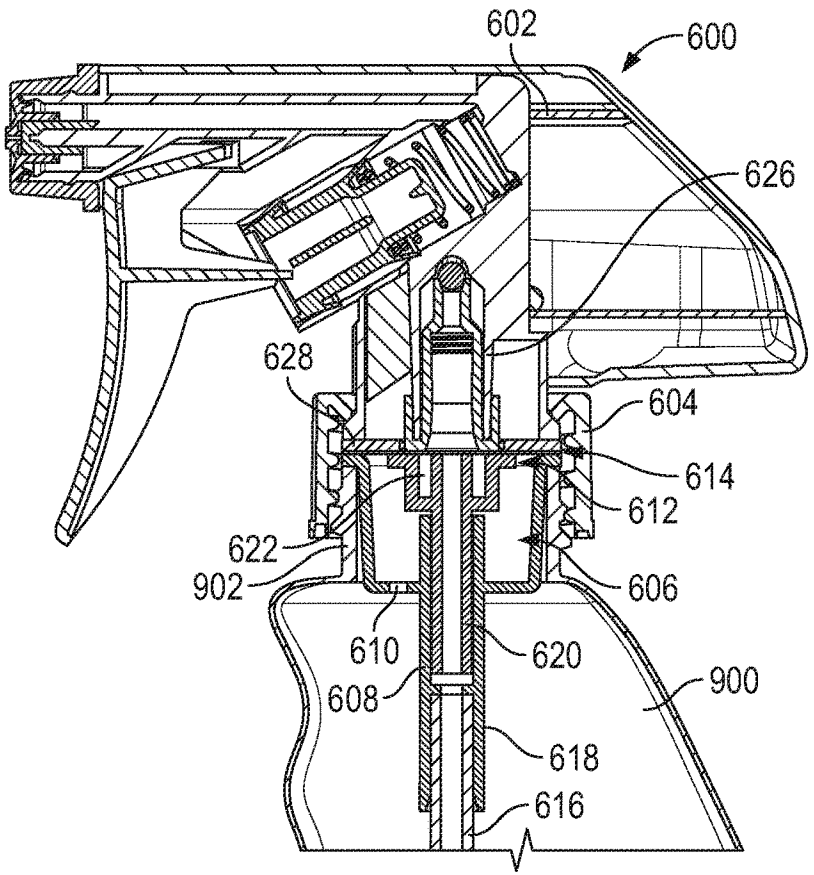
FIG. 29 is a cross-sectional view thereof taken along line 29-29 of FIG. 27.
Figure 32:
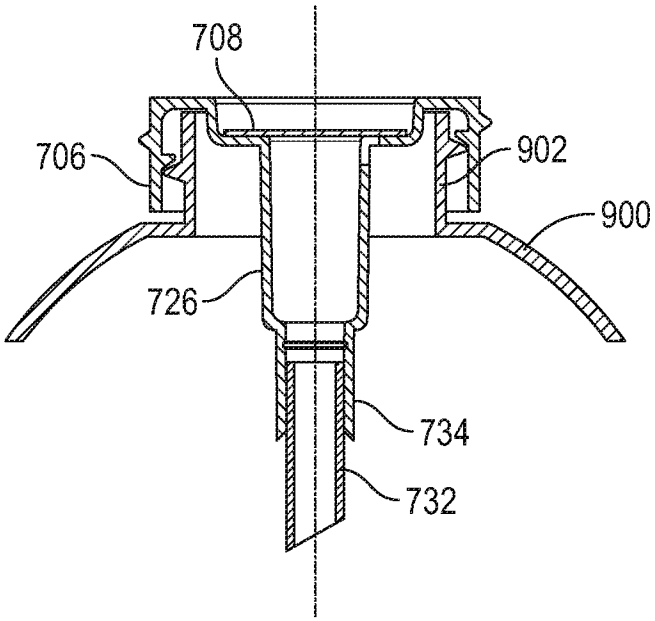
FIG. 32 is a cross-sectional view thereof taken along line 32-32 of FIG. 31.

As best seen in FIG. 26, the lower closure portion 504 has an axial flow conduit 526 as well as vent conduits 528 which are located within corresponding recesses 540 concentrically surrounding the flow conduit 526. The seal 508 is disposed over the entire upper surface of the lower closure portion 504 to seal both the flow conduit 526 and the venting conduits 528. The piercing probe 510 has a central axial piercing element 552A for the flow conduit 526 and aligned concentric elements 552B for the recesses 540 (better seen in FIGS. 24-25).

Figure 24:
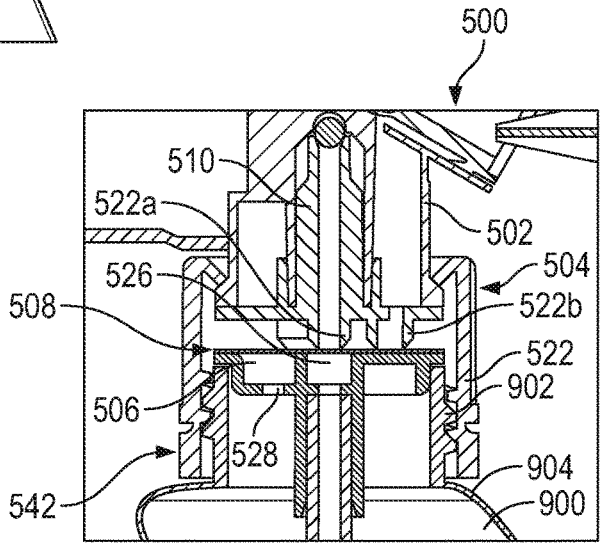
FIG. 24 is a cross-sectional view thereof taken along line 24-24 of FIG. 23.
Figure 25:
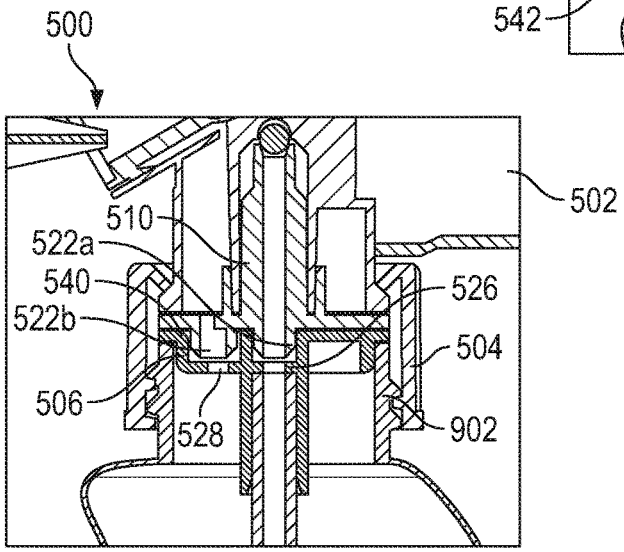
FIG. 25 is another cross-sectional view thereof with the spacing strip removed and the upper closure portion tightened down onto the bottle neck.

In use, the piercing elements 552A,552B are spaced from the seal 508 when the upper closure portion 504 is in the inactive extended shipping position (FIG. 24). However, when the spacing strip 542 is removed and the upper closure portion 504 is rotated (on the container neck 902) and axially moved from the inactive shipping position to the active dispensing position (FIG. 25) the piercing elements 552A, 552B move downwardly and pierce the foil seal 508 to open the flow conduit 526 and the vent conduits 528 and allow liquid from the container 900 to travel through the piercing probe 510 into the dispensing head 502 (See arrow in FIG. 25).

In another exemplary embodiment indicated at 600 and illustrated in FIGS. 27-30, a closure system 600 comprises a spray dispensing head 602, a closure ring 604 receiving the dispensing head 602, a cup-shaped bottle adapter 604 having an axial flow conduit 608 and a vent conduit 610 adjacent to the flow conduit 608, a reversible tubular flow adapter 612, and a user-removable seal 614.

The bottle adapter 606 is received and supported within the neck 902 of the container 900 and a dip tube 616 extends from a dip tube port 618 on the bottom wall of the adapter 606. The vent conduit 610 may be in the bottom wall as well, adjacent to the flow conduit 608.

The reversible tubular flow adapter 612 has a stem portion 620 at a first end and an annular concentric seat portion 622 at a second end. The flow adapter 612 provides two different functions depending on its deployed configuration.

In a shipping configuration (FIG. 29), the stem portion 620 is received into the axial flow conduit 608 of the bottle adapter 606 with the seat portion 622 sitting within the interior of the bottle adapter 606. The removable seal 614 is adhered around the peripheral upper lip 624 of the bottle adapter 606 to create a seal and prevent leaks through either the flow conduit 608 or the vent conduit 610. The seal 614 may include a transversely oriented pull tab to facilitate removal by the consumer. The closure ring 604 captures the bottle adapter 604 within the container neck 905 until it reaches the end consumer. Once received, the user removes (unscrews) the closure ring 604, removes (peels away) the seal 614, removes the flow adapter 612 and reverses the flow adapter configuration to mount the seat portion end 622 onto the flow conduit 608 (See FIG. 30). The closure ring 604 and dispenser head 602 are reattached with the stem portion 620 of the flow adapter 608 now extending up into the flow conduit 626 of the dispenser head 602 for normal use. A gasket ring 628 may be received between the closure ring 604 and the bottle adapter 606. The gasket ring 628 includes a central opening 630 through which the flow adapter 612 extends and operates to stabilize the axial orientation of the flow adapter 612 and flow conduit 626 in the deployed dispensing configuration.

Figure 31:
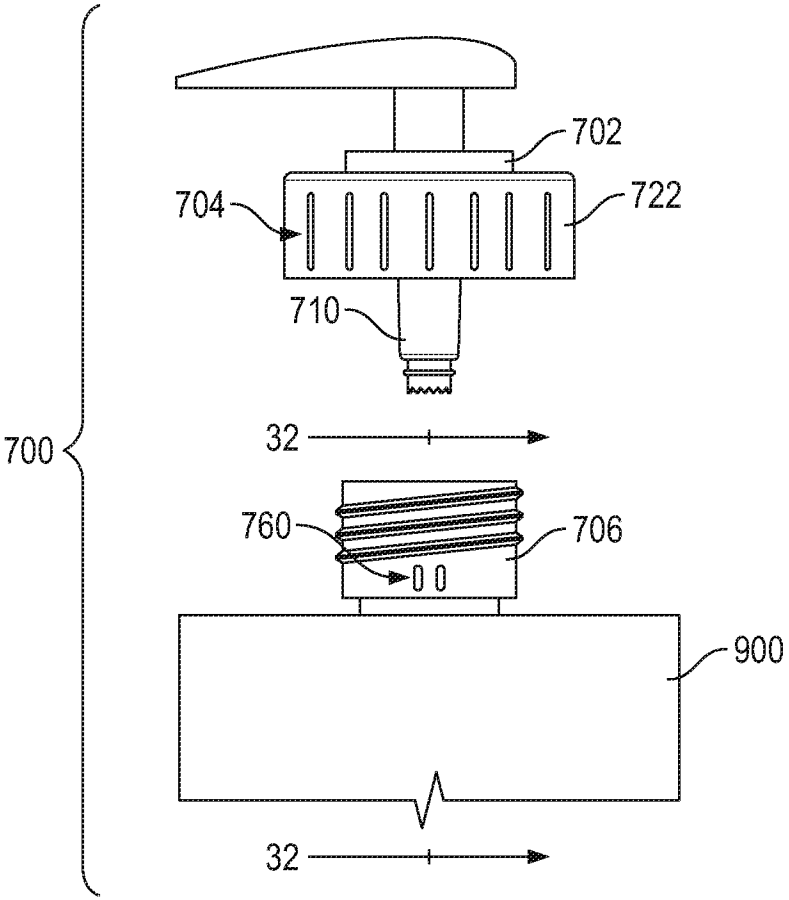
FIG. 31 illustrates a further exemplary embodiment including temporary physical stops on the closure portions.

In some embodiments, the thread paths in the upper and lower closures may include molded stops to provide temporary physical stops during initial capping. Referring to FIGS. 31-31, an embodiment in this configuration is generally indicated at 700. The dispensing closure system 700 includes a pump-style dispensing head 702, a lower closure portion 706 received on the neck 902 of the container 900, and an upper closure portion 704 having an outer skirt 722.

The skirt of the lower closure 706 is inwardly threaded to engage with the container neck 902 and also outwardly threaded to receive the outer skirt 722 of the upper closure 704. The lower closure 706 includes an axial flow conduit 726 with a dip tube port 734 and dip tube 732. A seal 708 is received over the axial flow conduit 726.

The upper closure 704 includes a coaxial piercing probe 710 which is configured to mate with and be received within the axial flow conduit 726 when fully deployed.

In contrast with the previous embodiments, the thread paths of the upper and lower closures 704, 706 include molded stops or nubs 760 which provide temporary physical stops for rotation of the upper closure 704 relative to the lower closure 706 during initial capping (stops 760 only shown on lower closure 706).

When initially capped, stops 760 engage and position the piercing probe 710 spaced above the seal 708. However, when the consumer receives the product, the consumer can force further rotation of the upper closure portion 704 (and dispensing head 702), beyond the stops 760, from the inactive shipping position to an active dispensing position. The piercing probe 710 moves downwardly into the flow conduit 726 and pierces the foil seal 708 to open the flow conduit 726 and allow product from the container 900 to travel through the piercing probe 710 into the dispensing head 702. The lower closure 706 may also include a venting passage.

The exemplary embodiments as illustrated depict both a spray-type dispensing head for liquids as well as a pump-style dispensing head. It should be understood that some embodiments of the invention may include other pump dispensers, pump engines and/or other dispenser heads for dispensing shampoos, soaps, lotions, gels and other viscous and non-viscous flowable products. Any container holding a liquid or flowable product would benefit from the present technology.

It should be noted each of the components of the exemplary embodiments may be molded from polymers, plastics, urethanes or otherwise formed from suitable materials as desired and may formed by any suitable manufacturing techniques available in the industry.

It can therefore be seen that the present disclosure provides for a novel dispensing closure system for liquid products which reduces leaks during shipment and handling of individual container units in e-commerce distribution systems. The internal shipping seal and closure locking systems provide two separate protections for preventing leaks from occurring during such e-commerce shipments.

Having thus described certain particular embodiments of the invention, it is understood that the invention defined by the appended claims is not to be limited by particular details set forth in the above description, as many apparent varia-tions thereof are contemplated. Rather, the invention is limited only be the appended claims, which include within their scope all equivalent devices or methods which operate according to the principles of the invention as described.

What is claimed is:

1. A dispensing closure system, comprising:

an upper closure portion comprising an outer skirt;

a tear away spacing strip connected to a lower portion of the outer skirt; and a lower closure portion, comprising:

an upper surface;

a plurality of recessed in the upper surface an axial flow conduit; and a plurality of vent conduits in the plurality of recesses; and a seal disposed over the upper surface.

2. The dispensing closure system of claim 1, further comprising a container attached to the upper closure portion, comprising a shoulder portion, wherein the tear away strip engages the shoulder portion of the container.

3. The dispensing closure system of claim 1, wherein the plurality of vent conduits concentrically surround the axial flow conduit.

4. The dispensing closure system of claim 1, wherein the axial flow conduit defines an opening in the upper surface.

5. The dispensing closure system of claim 1, wherein the plurality of vent conduits define openings in the upper surface.

6. The dispensing closure system of claim 1, further comprising a piercing probe.

7. The dispensing closure system of claim 1, further comprising a piercing probe seated in the upper closure portion, comprising:

a central axial piercing element; and aligned concentric elements.

8. The dispensing closure system of claim 7, wherein removal of the tear away spacing strip allows rotational movement of the upper closure portion and movement of the piercing probe to pierce the seal and align the central axial piercing element with the axial flow conduit and the aligned concentric elements with the plurality of recesses.

9. The dispensing closure system of claim 1, further comprising a dispensing head attached to the upper closure portion.

10. The dispensing closure system of claim 9, wherein the dispensing head is a spray dispensing head.

11. The dispensing closure system of claim 9, wherein the dispensing head is a pump-style dispensing head.

12. A dispensing closure system mounted on a container, comprising:

an upper closure portion comprising a threaded outer skirt engaged with a threaded neck of the container;

a dispensing head comprising a throat portion received in the upper closure portion;

a tear away spacing strip connected to a lower portion of the threaded outer skirt and in contact with a shoulder portion of the container;

a lower closure portion seated within the neck of the container, comprising:

an upper surface;

an axial flow conduit; and a plurality of vent conduits;

a seal over the upper surface; and a piercing probe seated in the upper closure portion between the dispensing head and the seal.

13. The dispensing closure system mounted on a container of claim 12, wherein removal of the tear away spacing strip allows rotational movement of the upper closure portion.

14. The dispensing closure system mounted on a container of claim 13, wherein rotational movement of the upper closure portion moves the piercing probe towards the seal and pierces the seal.

15. The dispensing closure system mounted on a container of claim 12, wherein the piercing probe further comprises:

a central axial piercing element; and aligned concentric elements.

16. The dispensing closure system mounted on a container of claim 15, wherein movement of the piercing probe aligns the central axial piercing element with the axial flow conduit and the aligned concentric elements with the plurality of vent conduits.

17. The dispensing closure system mounted on a container of claim 12, wherein the dispensing head is selected from the group consisting of a spray dispensing head and a pump-style dispensing head.

* * * * *